US010352178B2

(12) United States Patent
Humhauser et al.

(10) Patent No.: US 10,352,178 B2
(45) Date of Patent: Jul. 16, 2019

(54) LOCKING ELEMENT AND TURBOMACHINE

(71) Applicant: MTU Aero Engines AG, Munich (DE)

(72) Inventors: Werner Humhauser, Moosburg (DE); Hermann Klingels, Dachau (DE)

(73) Assignee: MTU Aero Engines AG, Munich (DE)

( * ) Notice: Subject to any disclaimer, the term of this patent is extended or adjusted under 35 U.S.C. 154(b) by 537 days.

(21) Appl. No.: 15/043,643

(22) Filed: Feb. 15, 2016

(65) Prior Publication Data

US 2016/0245101 A1 Aug. 25, 2016

(30) Foreign Application Priority Data

Feb. 24, 2015 (DE) ..... 10 2015 203 290

(51) Int. Cl.
*F01D 5/32* (2006.01)
*F01D 5/30* (2006.01)
*F04D 29/32* (2006.01)

(52) U.S. Cl.
CPC ..... *F01D 5/326* (2013.01); *F01D 5/3007* (2013.01); *F01D 5/3038* (2013.01); *F01D 5/32* (2013.01); *F04D 29/322* (2013.01); *F05D 2220/323* (2013.01); *F05D 2260/30* (2013.01)

(58) Field of Classification Search
CPC ..... F01D 5/3038; F01D 5/32; F04D 29/322
See application file for complete search history.

(56) References Cited

U.S. PATENT DOCUMENTS 4,255,086 A 3/1981 Roberts
4,684,325 A * 8/1987 Arnold ..... F01D 5/3038 29/889.21
4,859,149 A 8/1989 McClain
6,638,006 B2 * 10/2003 Selby ..... F01D 5/3038 415/9
6,752,598 B2 * 6/2004 Antunes ..... F01D 5/3038 416/215
6,981,847 B2 * 1/2006 Arinci ..... F01D 5/3038 416/193 A
7,435,055 B2 * 10/2008 Hansen ..... F01D 5/3038 416/215
7,708,529 B2 5/2010 Klingels
8,523,529 B2 * 9/2013 Brittingham ..... F01D 5/3038 416/215

(Continued)

FOREIGN PATENT DOCUMENTS

CA 2829460 A1 4/2014
GB 2156908 A 10/1985

*Primary Examiner* — Kevin F Murphy
(74) *Attorney, Agent, or Firm* — Barlow, Josephs & Holmes, Ltd.

(57) ABSTRACT

A locking element for a row of blades of a turbomachine includes a number of blades that are inserted by their roots in an anchoring groove on the rotor side and are thereby held in the radial direction in form-fitting manner in the anchoring groove. The locking element has a basic body that has a front bearing surface and a back bearing surface for form-fitting with opposite-lying groove surfaces, a front lock projection and a back lock projection for engaging in opposite-lying recesses of the anchoring groove, and a threaded region for interacting with a tightening element. Access to the threaded region for the tightening element is blocked on one side.

10 Claims, 3 Drawing Sheets

(56) References Cited

U.S. PATENT DOCUMENTS

| | | | | |
|---|---|---|---|---|
| 8,899,934 | B2 * | 12/2014 | Hirata | F01D 5/3038 416/215 |
| 2012/0251329 | A1 | 10/2012 | Hirata et al. | |
| 2012/0275918 | A1 | 11/2012 | Wiebe | |

* cited by examiner

LOCKING ELEMENT AND TURBOMACHINE

BACKGROUND OF THE INVENTION

The invention relates to a locking element for a row of blades of a turbomachine and to a turbomachine.

A known construction principle for rows of blades, in particular for rows of rotating blades, of a turbomachine, such as an aircraft engine, a stationary gas turbine, or a steam turbine provides for inserting blades of the respective rows of blades with their roots in an anchoring groove on the rotor side. In the radial direction, the blades are held by their roots in form-fitting manner in the anchoring groove. In the peripheral direction, locking in position is produced by a locking element that is inserted in the anchoring groove. A known locking element has a basic body that has a front bearing surface and a back bearing surface for form-fitting with opposite-lying groove surfaces, a front lock projection and a back lock projection for engaging in opposite-lying recesses of the anchoring groove, and a threaded region for interacting with a tightening element. After introducing the blades into the anchoring groove, the locking element is inserted, moved into its peripheral position, and brought into its locking position by the tightening element or it is tightened from below against the groove surfaces. In this case, a plate-shaped bridge element is disposed between the locking element . . . so that it is pressed from above against the groove surfaces during the tightening of the tightening element, whereupon the locking element is tightened from below against the groove surfaces. Such a construction principle is shown in U.S. Pat. No. 7,708,529 B2 of the Applicant as the prior art. A locking element that interacts with a screw and a plate-shaped bridge element is also known from U.S. Pat. No. 4,859,149. A threaded borehole passes through the locking element, and a screw is screwed into the borehole. The bridge element is disposed between the locking element . . . *, and, in combination with the screw, effects a lifting or locking of the locking element against the groove surfaces of the anchoring groove. It has been shown, however, with these principles, that the locking element can be screwed by its inner side radially outward, due to the construction, whereby the lock projections do not engage in the recesses on the side of the groove and the blades are not locked relative to the periphery and can disintegrate.

In addition, a locking of rotating blades in the peripheral direction is realized in U.S. Pat. No. 7,708,529 B2 in that the anchoring groove has crenelated radial projections through which locking pins pass axially and thereby form lateral stops for the rotating blades.

A locking element that has a threaded borehole passing through it for receiving a screw in the vertical direction is shown in CA 2829460 A1 and in GB 2 156 908 A. By screwing in the screw, the latter is supported at the base of the groove and thereby raises the locking element against corresponding groove surfaces. For interacting with so-called closure blades, the locking element has a tube-like projection or a collar that concentrically surrounds the threaded borehole.

Locking elements that are threaded onto a wire ring inserted into an anchoring groove are known from U.S. Pat. No. 4,255,086.

SUMMARY OF THE INVENTION

An object of the invention is to create a locking element for a row of blades of a turbomachine, in which a faulty mounting is prevented. In addition, an object of the invention is to create a turbomachine with an increased reliability.

These objects are achieved by a locking element with the features of the present invention.

A locking element according to the invention for a row of blades of a turbomachine, wherein the row of blades comprises a plurality of blades that are inserted by their roots in an anchoring groove on the rotor side and are thereby held in the radial direction in form-fitting manner in the anchoring groove, has a basic body that has a front bearing surface and a back bearing surface for form-fitting with opposite-lying groove surfaces, a front lock projection and a back lock projection for engaging in opposite-lying recesses of the anchoring groove, and a threaded region for interacting with a tightening element. According to the invention, the threaded region for the tightening element is accessible only on one side.

Due to the one-sided accessibility of the threaded region, the tightening element can only be placed on the threaded region from one side. In this way, a faulty mounting of the locking element is reliably prevented, since the tightening element can be brought into working engagement with the threaded region inside the anchoring groove only in the correct positioning of the locking element. In a faulty positioning, the access for the tightening element to the threaded region is blocked. Due to its construction, the locking element according to the invention cannot be screwed outward by its inner side or by its underside. A modification of closure blades in order to avoid a faulty mounting is not necessary.

In an exemplary embodiment, the threaded region is a closed inner thread borehole on the bottom side. By forming an inner thread borehole, one can have recourse to known techniques, whereby a reliable closing is produced due to the closure on the bottom side.

Preferably, the inner thread borehole is a through-borehole and is closed on the bottom at the basic body by an external closure element, for example a plate element. The inner thread borehole can be introduced in a technically simple manner due to the nature of its continuous passage, and the subsequent closure on the bottom, i.e., depending on the design of the inner thread borehole, makes possible a technically simple closing. For example, the external closure element is affixed by material bonding, such as soldering or welding to the basic body. This variant makes possible the retrofitting of existing locking elements with closure elements, so that existing locking elements can also be protected against faulty mounting.

Alternatively, the inner thread borehole is a through borehole and is closed on the bottom by an internal closure element. The internal closure element is, for example, a stopper element that projects by a segment into the inner thread borehole. This makes possible a force-fitting and form-fitting mounting on the basic body.

The inner thread borehole can also be a blind borehole. The number of parts of the locking element is reduced by this measure, since separate closure elements are dispensed with for the one-sided closing of the threaded region. Also, mounting time will be shortened by omitting the mounting of the closure elements.

In one exemplary embodiment, the threaded region is a threaded pin extending from the basic body. The threaded pin clearly specifies the installation position, so that a false insertion of the locking element into the anchoring groove is effectively prevented. A nut serves as a tightening element in this variant. In this case, the basic body per se acts as an access block for the tightening element.

The threaded pin can be inserted into an uptake hole of the basic body. Due to this measure, the basic body and the threaded pin will be produced individually, which makes possible a simple manufacture. The threaded pin can be joined to the basic body, for example, by means of screwing into the uptake hole, by a catch connection resistant to rotation, and like measures.

The threaded pin can also be bonded cohesively to the basic body. A cohesive bond is a reliable and technically manageable connection and, for example, can be achieved by welding and soldering. Of course, the threaded pin can also be inserted into the uptake hole and can be welded on the peripheral side to the basic body, for example, in the mouth region of the uptake hole.

Alternatively, the threaded pin is an integral segment of the basic body. By this measure, the number of parts and the mounting of the locking element will be reduced. For example, the locking element is manufactured according to a selective or adaptive manufacturing method, such as laser sintering, laser melting, and the like. Such manufacturing methods also make possible, in particular, a flexible shaping of the basic body and of the threaded pin or threaded stopper.

A preferred turbomachine has a row of blades, the blades of which are locked in the peripheral direction by means of a locking element according to the present invention. In a row of blades of this type, a faulty mounting of the locking element is prevented, so that the preferred turbomachine is characterized by an increased reliability in comparison to known turbomachines without the locking element according to the invention.

Other advantageous embodiment examples of the invention are described in detail below.

BRIEF DESCRIPTION OF THE DRAWING FIGURES

Preferred examples of embodiment of the invention will be explained in more detail in the following on the basis of schematic representations. Herein:

DESCRIPTION OF THE INVENTION

Figure 1:
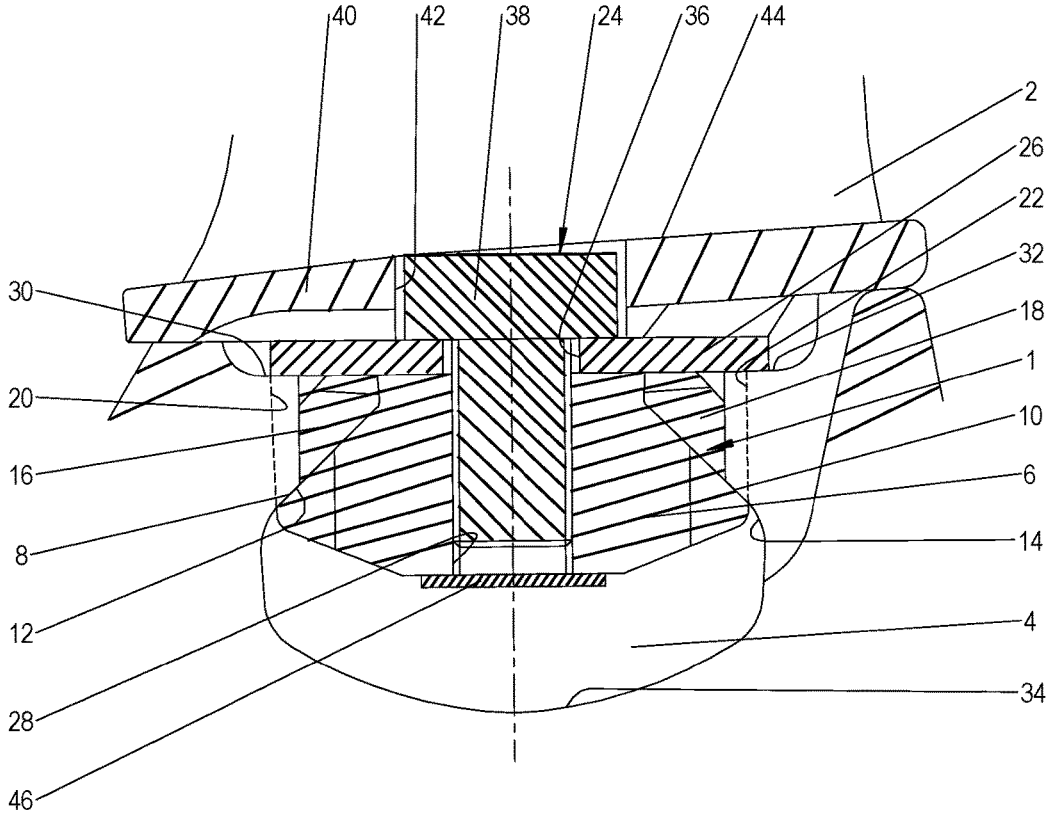
FIG. 1 shows a longitudinal section through a first exemplary embodiment of a locking element according to the invention inserted in a rotor-side anchoring groove of a turbomachine.

A sectional view of a first exemplary embodiment of a locking element 1 according to the invention for a row of blades of a turbomachine is shown in FIG. 1.

With reference to FIG. 1, a primary flow passes through the turbomachine from left to right, in the direction of the machine's longitudinal axis, thus in the axial direction. Terms such as "back" and "front" refer to the flow direction of the primary flow; terms such as "radial" refer to the longitudinal axis of the rotor or machine of the turbomachine. The turbomachine is, for example, a gas turbine and, in particular, an aircraft engine.

The row of blades is composed of a plurality of rotating blades 2 disposed next to one another in the peripheral direction of the turbomachine. Each of the rotating blades 2 is taken up by its root or root section covered by the locking element 1 in a rotor-side and peripheral anchoring groove 4.

The locking element 1 is inserted in the anchoring groove 4 of the turbomachine and acts as a peripheral lock for the rotating blades 2. A radial locking of the rotating blades 2 is provided in form-fitting manner by their roots in the anchoring groove 4. The locking element 1 has, in the broadest sense, a cuboid, metal basic body 6 and is clamped to opposite-lying groove surfaces 12, 14 of the anchoring groove 4 by means of a front bearing surface 8 and a back bearing surface 10 of the basic body 6. It penetrates in opposite-lying recesses 20, 22 of the anchoring groove 4 by a front lock projection 16 and by a back lock projection 18. The clamping is provided by means of a tightening element 24, which is a screw here, and by means of a plate-shaped bridge element 26. The screw 24 is screwed into a threaded region 28 of the basic body 6 and is supported by its screw head 38 on the bridge element 26, which lies on the edge side on supporting surfaces 30, 32 of the anchoring groove 4, these surfaces being opposite to the groove surfaces 12, 14. The screw 24 is, for example, a screw with hexagon socket that is actuated by a tool engaged in the screw head 38 on the front side. By tightening the screw 24 or the tightening element, the bridge element 26 is pressed from the top against the supporting surfaces 30, 32 and in this way, the basic body 6 is pulled from below against the groove surfaces 12, 14, whereby, in addition to its fixation in its locking position, it is also lifted from the base 34 of the groove. For conducting the screw 24 on the shaft side, the bridge element 26 has a corresponding through-passage borehole 36. For uptake of the screw head 38, the so-called closure blades have corresponding recesses 42 in the region of their radially inner platforms 40. In order to avoid turbulence in the region of the primary flow, the screw head 38 is arranged in the screwed-in state underneath a platform surface 44 on the side of the annular space.

In this exemplary embodiment, the threaded region 28 is an inner thread borehole passing through the basic body 6 in the vertical direction. In FIG. 1, the direction of height or vertical direction is indicated by the dot-dash vertical line. In order to prevent a faulty mounting of the locking element 1, the threaded region 28 is closed externally on the bottom via a plate-shaped closure element 46. Thus, the threaded region 28 or the inner thread borehole is accessible to the screw 24 only from one side.

Figure 2:
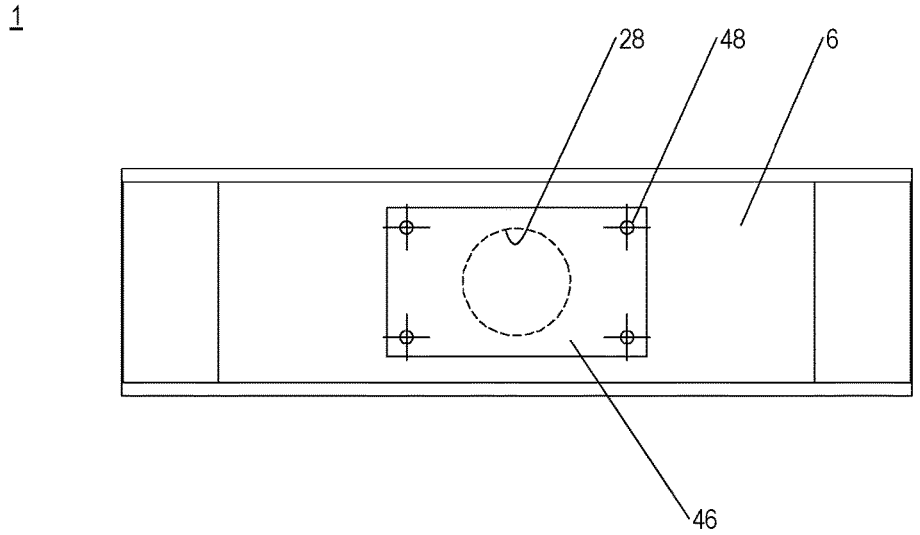
FIG. 2 shows a bottom view of the first exemplary embodiment.

As is indicated in FIG. 2 by four crosses 48, the external closure element 46 is manufactured separately from the basic body 6 and subsequently joined to it. The closure element 46 is metal, as is the basic body 6. The joining is made, for example by means of material bonding or cohesion, more preferably by means of spot welding or soldering.

Figure 3:
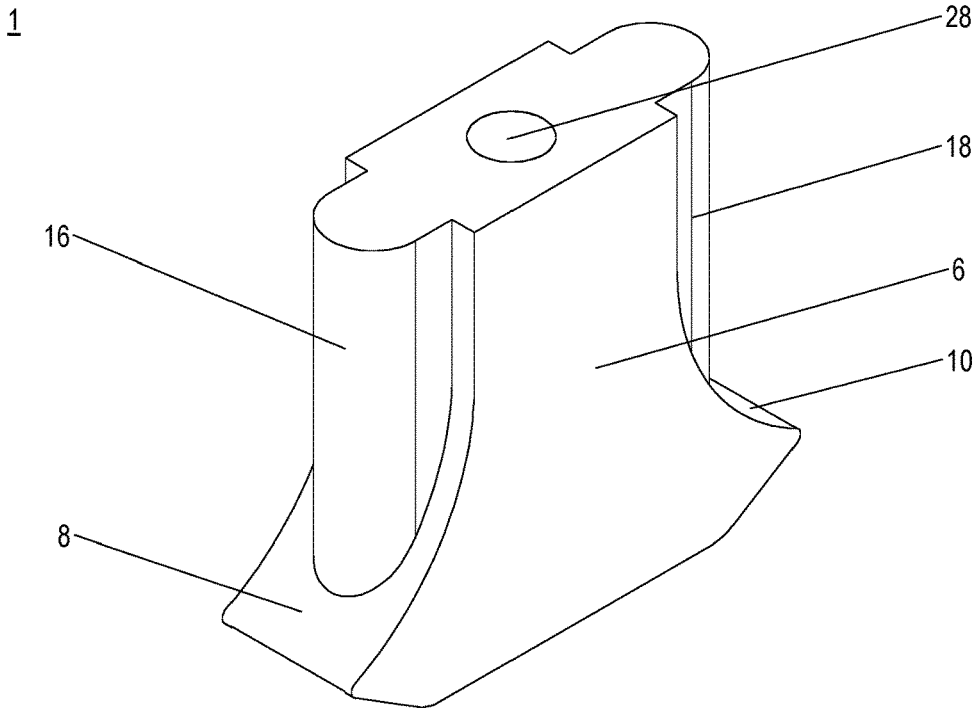
FIG. 3 shows a perspective top view onto the first exemplary embodiment.

A perspective top view onto the first exemplary embodiment of the locking element 1 according to the invention is shown in FIG. 3. The basic body 6, the lock projections 16, 18 opposite to one another, the bearing surfaces 8, 10 opposite to one another, and the inner thread borehole 28 can be clearly recognized in this figure.

Figure 4:
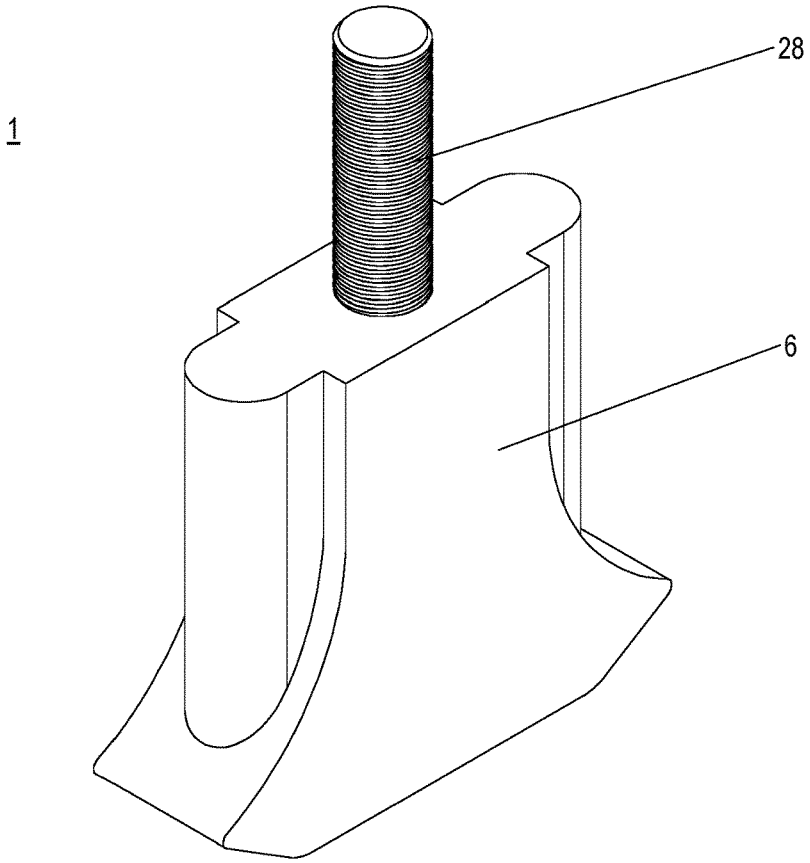
FIG. 4 shows a perspective illustration of a second exemplary embodiment of the locking element according to the invention.

A second example of embodiment of the locking element 1 according to the invention is shown in FIG. 4. Unlike the first exemplary embodiment according to FIGS. 1 to 3, in this exemplary embodiment, the basic body 6 itself acts to block access on one side to a tightening element, and thus acts as closure element 46. For this purpose, the threaded region 28 is formed as a threaded pin with an outer thread extending in the vertical direction The tightening element, which is not shown, is correspondingly a nut for screwing onto the threaded pin 28. The threaded pin 28 is preferably an integral segment of a basic body 6 of the locking element 1 and is fabricated with it during its manufacture. It is not a separate part, but is formed in the framework, for example, of a selective or adaptive manufacture of the basic body 6. Examples of manufacturing methods are laser sintering or laser melting.

Figure 5:
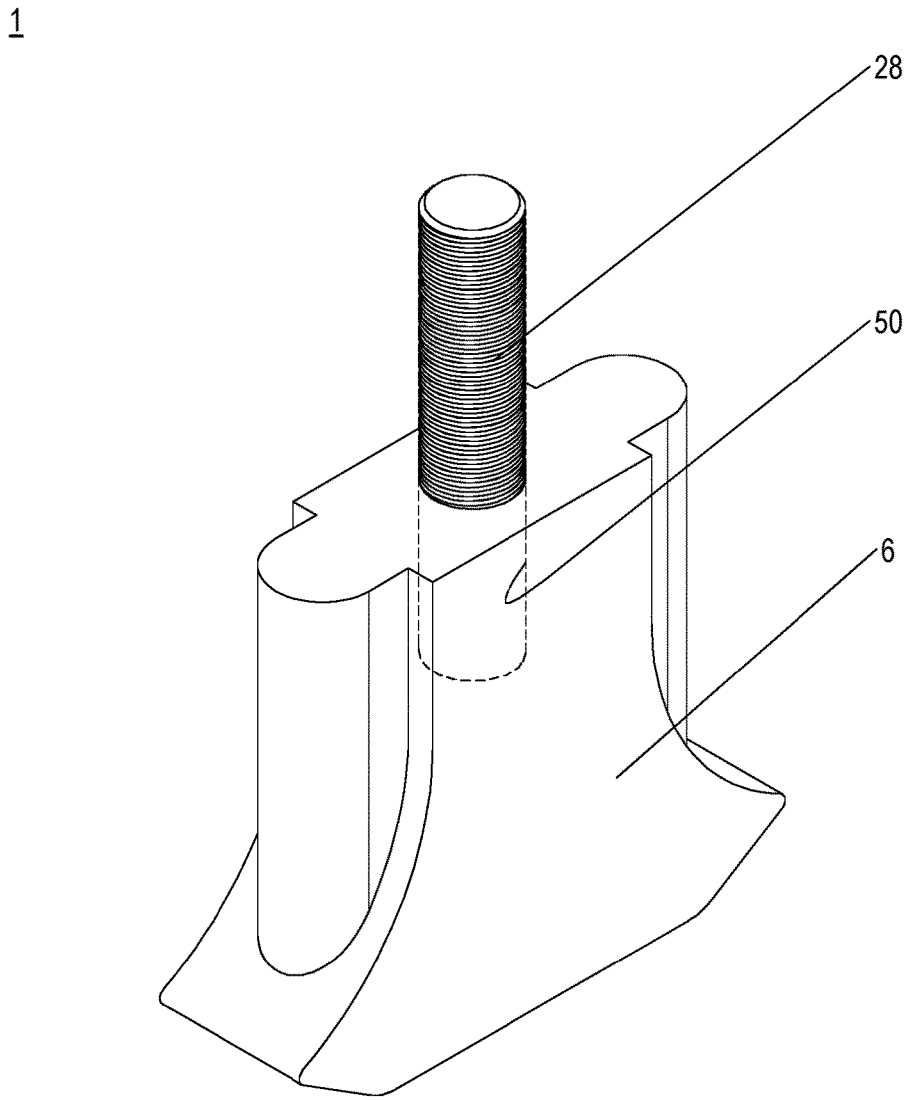
FIG. 5 shows a perspective illustration of a third exemplary embodiment of the locking element according to the invention.

A third example of embodiment of the locking element 1 according to the invention is shown in FIG. 5. Unlike the second exemplary embodiment according to FIG. 4, a threaded pin 28 is a part separate from a basic body 6 of the locking element 1 and a section of it is inserted into an uptake borehole 50 of the basic body 6. For example, the uptake borehole 50 has an inner thread and the threaded pin 28 is correspondingly screwed into the uptake borehole 50.

Disclosed is a locking element for a row of blades of a turbomachine, wherein the row of blades comprises a plurality of blades that are inserted by their roots in an anchoring groove on the rotor side and are thereby held in the radial direction in form-fitting manner in the anchoring groove, the locking element having a basic body that has a front bearing surface and a back bearing surface for form-fitting with opposite-lying groove surfaces, a front lock projection and a back lock projection for engaging in opposite-lying recesses of the anchoring groove, and a threaded region for interacting with a tightening element, wherein access for the tightening element to the threaded region is blocked on one side; as well as a turbomachine.

What is claimed is:

1. A locking element for a row of blades of a turbomachine, wherein the row of blades comprises a plurality of blades that are inserted by their roots in an anchoring groove on a rotor side and are thereby held in a radial direction in form-fitting manner in the anchoring groove, the locking element having a basic body that has a front bearing surface and a back bearing surface for form-fitting with opposite-lying groove surfaces, a front lock projection and a back lock projection for engaging in opposite-lying recesses of the anchoring groove, a threaded region for interacting with a tightening element, and the tightening element having a screw head and a threaded shaft, the threaded shaft being disposed in the threaded region, wherein the threaded region is an inner thread borehole closed on the bottom by a closure which is fixed relative to the basic body such that the tightening element cannot be inserted from the bottom of the basic body, and wherein the threaded region for the tightening element is accessible only from the top side of the basic body.

2. The locking element according to claim 1, wherein the inner thread borehole is a through-borehole and the closure is an external closure element.

3. The locking element according to claim 1, wherein the inner thread borehole is a through-borehole and the closure is an internal closure element.

4. The locking element according to claim 1, wherein the inner thread borehole is a blind borehole.

5. The locking element according to claim 1, wherein the row of blades is locked in the peripheral direction by the locking element.

6. A locking element for a row of blades of a turbomachine, wherein the row of blades comprises a plurality of blades that are inserted by their roots in an anchoring groove on a rotor side and are thereby held in a radial direction in form-fitting manner in the anchoring groove, the locking element having a basic body that has a front bearing surface and a back bearing surface for form-fitting with opposite-lying groove surfaces, a front lock projection and a back lock projection for engaging in opposite-lying recesses of the anchoring groove, a threaded region for interacting with a tightening element, the threaded region including a threaded pin extending upward from a top most side of the basic body, and the tightening element is a nut that includes a female threaded region which receives the threaded region, wherein the threaded region for the tightening element is accessible only from the top most side of the basic body.

7. The locking element according to claim 6, wherein the threaded pin is inserted into an uptake hole of the basic body.

8. The locking element according to claim 7, wherein the threaded pin is bonded cohesively to the basic body.

9. The locking element according to claim 6, wherein the threaded pin is bonded cohesively to the basic body.

10. The locking element according to claim 6, wherein the threaded pin is an integral segment of the basic body.

* * * * *